United States Patent [19]

O'Brien et al.

[11] 4,448,974

[45] May 15, 1984

[54] POLYALKYLENE SUCCINIMIDE LUBRICANT ADDITIVES

[75] Inventors: Joseph P. O'Brien, Kirkwood; Andrew G. Papay, Manchester, both of Mo.

[73] Assignee: Edwin Cooper, Inc., St. Louis, Mo.

[21] Appl. No.: 361,519

[22] Filed: Mar. 24, 1982

[51] Int. Cl.[3] ..... C07D 207/412

[52] U.S. Cl. ..... 548/550; 252/51.5 A

[58] Field of Search ..... 548/550

[56] References Cited

U.S. PATENT DOCUMENTS 3,219,666 11/1965 Norman et al. ..... 548/550

3,723,460 3/1973 Brannen et al. ..... 548/550

*Primary Examiner*—Paul M. Coughlan, Jr.

*Assistant Examiner*—David B. Springer

*Attorney, Agent, or Firm*—Donald L. Johnson; John F. Sieberth; Joseph D. Odenweller

[57] ABSTRACT

A lubricating oil dispersant made by reacting an aldehyde (e.g. isobutyraldehyde) with an amine (e.g. tetraethylenepentamine) under conditions to form a Schiff base which is then reacted with a hydrocarbon-substituted succinic acid, anhydride or lower alkyl ester.

24 Claims, No Drawings

POLYALKYLENE SUCCINIMIDE LUBRICANT ADDITIVES

BACKGROUND

Dispersants are conventionally used in engine lubricating oil to keep internal parts clean and to prevent the accumulation of sludge. Many effective additives are known. One such additive that is used commercially is a polybutene-substituted succinimide of ethylene polyamine (U.S. Pat. No. 3,172,892).

SUMMARY

It has now been discovered that very effective ashless dispersants for use in lubricating oil can be made by reacting an aliphatic hydrocarbon-substituted succinic compound with a Schiff base. Use of high molecular weight aliphatic hydrocarbon substituents leads to dispersants which also have viscosity index improving properties.

DESCRIPTION OF PREFERRED EMBODIMENTS

A preferred embodiment of the invention is a lubricating oil additive having dispersant properties which is a product made by a process comprising (a) reacting about 0.5–10 moles of an aldehyde containing 1–20 carbon atoms with about 1–2 moles of an aliphatic amine containing 2–50 carbon atoms and 2–11 amine nitrogen atoms, at least one of which is a primary amine group, at elevated temperature while distilling out water formed in the reaction thereby forming a Schiff base and (b) reacting said Schiff base with about 0.5–5 moles parts of an aliphatic hydrocarbon substituted succinic acid, anhydride or lower alkyl ester.

Aldehydes useful in making a Schiff base include any aldehyde which will react with a primary amine group to form a Schiff base. The preferred aldehydes are the aliphatic aldehydes containing one to about 20 carbon atoms. Representative examples of these are formaldehyde, acetaldehyde, propionaldehyde, isobutyraldehyde, octanal, 2-ethylhexanal, 2-ethyloctanal, n-eicosanal, furfural, glyoxal, malonaldehyde, glutaraldehyde, fumaraldehyde, and the like, including mixtures thereof.

The more preferred aldehydes are the aliphatic monoaldehydes containing about 4 to 8 carbon atoms such as butyraldehyde, isobutyraldehyde, hexanal, 2-ethyl butyraldehyde, pentanal, isopentanal, heptaldehyde, octanal, 2-ethyl hexanal, and the like, including mixtures thereof.

Amines useful in the invention include those having at least one primary amine group capable of reacting with an aliphatic aldehyde to form a Schiff base. Preferably, these are aliphatic polyamines containing about 2–50 carbon atoms and 2–11 amine nitrogen atoms, at least one of which is a primary amine group. Representative examples include N,N-dimethyl-1,3-propanediamine, ethylenediamine, 1,4-butanediamine, 1,6-hexanediamine, N-(aminoethyl) piperazine, N-(aminopropyl) piperazine, N-(aminoethyl) morpholine, ethanolamine and the like, including mixtures thereof.

A useful class of amines are the alkylene polyamines which can be represented by the formula $$H_2N—R_1—NH—_nH$$

wherein $R_1$ is a divalent aliphatic hydrocarbon containing 2–4 carbon atoms and n is an integer from 1–10.

Representative examples of these include ethylenediamine, 1,2-propylenediamine, 1,3-propanediamine, diethylenetriamine, triethylenetetramine, tetraethylenepentamine, pentaethylenehexamine, hexaethyleneheptamine, dipropylenetriamine, and the like, including mixtures thereof.

Another useful class of amines are the amines having the structure $$R_2\text{-}[NH—R_3]_pNH_2$$

wherein $R_2$ is an aliphatic hydrocarbon group containing about 8–30 carbon atoms, $R_3$ is a divalent aliphatic hydrocarbon group containing 2–4 carbon atoms and p is an integer from 1–4. Representative examples of these amines include N-tetradecyl ethylenediamine, N-octadecyl ethylenediamine, N-octadecenyl ethylenediamine, N-dodecyl ethylenediamine, N-(dodecylaminoethyl) ethylenediamine, N-(octadecenylaminobutyl)-1,3-butanediamine, N-(triacontylaminoethyl)ethylenediamine, and the like, including mixtures thereof.

Most preferably, $R_3$ in the above formula is the group $—CH_2—CH_2—CH_2—$ and $R_2$ is an aliphatic hydrocarbon group containing 12–20 carbon atoms. Of these, the preferred amines are those in which p is 2 such as N-(octadecylaminopropyl)-1,3-propanediamine.

Another useful class of amines are the ether amines having the formula $$R_4\text{-}[O—R_5NH]_qH$$

wherein $R_4$ is an aliphatic hydrocarbon group containing about 1–30 carbon atoms, $R_5$ is a divalent aliphatic hydrocarbon group containing 2–4 carbon atoms and q is an integer from 2–4. Representative examples of these ether amines are N-[3-(methoxy) propyl]-1,3-propanediamine, N-[3-(octyloxy)-propyl]1,3-propanediamine, N-[4-(butoxy)butyl]-1,4-butanediamine, N-[3-(decyloxy)propyl]-1,3-propanediamine, N-[3-(dodecyloxy)-propyl]-1,3-propanediamine, N-[2-(octadecyloxy)ethyl]ethylenediamine, N-[4-(eicosyloxy)-butyl]1,4-butanediamine, N-[4-(triacontyloxy)-butyl]1,4-butanediamine, N-[3-[3-(hexyloxy)-propylamino]propyl]-1,3-propanediamine, N-[3-[3-(dodecyloxy)propylamino]propyl]-1,3-propanediamine, N-[2-[2-(octadecyloxy)ethylamino]ethyl]ethylenediamine, N-[3-[3-(eicosyloxy)propylamino]propyl]-1,3-propanediamine, and the like, including mixtures thereof.

Most preferably $R_4$ is an aliphatic hydrocarbon group containing 8–20 carbon atoms and $R_5$ is the group $—CH_2—CH_2—CH_2—$. Still more preferably q is 2.

The third reactant is an aliphatic hydrocarbon-substituted succinic acid, anhydride or lower alkyl ester thereof. Of these the most preferred is the anhydride although the acid or ester can be used. Lower alkyl esters include methyl, ethyl, propyl, butyl, isobutyl, and the like.

The aliphatic hydrocarbon substituent group is preferably a high molecular weight group which provides oil solubility. For example, a useful molecular weight range is about 300–300,000.

One preferred class of hydrocarbon substituents which provides additives having good dispersant properties are polybutenyl substituents having a molecular weight of about 500–10,000. Polybutenes in this molecular weight range are readily available. Heating a mixture of such polybutene and maleic anhydride at 200°–250° C. will form the polybutenyl-substituted succinic anhydride. This reaction may be catalyzed by chlorine or by peroxides.

Another class of aliphatic hydrocarbon substituents are the ethylene/propylene copolymers which can include other co-monomers. These substituents preferably have a weight average molecular weight in the range of about 10,000–300,000 and more preferably 50,000–200,000. Use of such substituted succinic compounds leads to additives having viscosity index improving properties in addition to being dispersants.

The more preferable copolymer substituents are derived from a copolymer containing about 25–60 weight percent ethylene units, about 30–74 weight percent propylene units and about 1–10 weight percent non-conjugated diene units. Such copolymers and methods for making them are described in U.S. Pat. Nos. 3,551,336; 3,598,738; 3,790,480; and 3,691,078.

In a still more preferred embodiment the copolymer substituent contains about 40–60 weight percent ethylene units, about 35–60 weight percent propylene units and about 1–10 weight percent of non-conjugated diene units. The diene units can be any of those described in the above-mentioned patents but preferably are derived from a diene selected from the group consisting of 1,4-hexadiene, 2,5-norbornadiene, dicyclopentadiene and ethylidene norbornene, including mixtures thereof.

The copolymer-substituted succinic compound can be made in a manner similar to that used to make the polybutene-substituted succinic compounds. Better results are obtained using a peroxide catalyst in the case of the high molecular weight copolymers.

The Schiff base is pre-formed by mixing the aldehyde and amine and heating the mixture to distill out water formed in the reaction. The mole ratio of aldehyde to amine can vary over a wide range. A useful range in which to experiment is about 0.5–10 moles of aliphatic aldehyde per each 1–2 moles of aliphatic amine. More preferably, about 1–5 moles of aldehyde are used per mole of amine.

The Schiff base formation is preferably conducted in an inert water-immiscible solvent which assists in water removal. Preferred solvents include aliphatic and aromatic hydrocarbons such as hexane, heptane, octane, nonane, petroleum ethers, benzene, toluene, xylene, and the like.

The Schiff reaction is conducted under conditions which will distill out water formed in the reaction. This can be at a temperature of about 70°–200° C. depending upon solvent and pressure. Preferably, the reaction is conducted at atmospheric pressure using a solvent having a boiling range of about 60°–120° C. This permits water removal under rather mild conditions.

Following formation of Schiff base, excess aldehyde and solvent can be removed by heating the mixture under vacuum to distill out volatile components. Excess amine can also be removed in this manner although this is not necessary and not readily accomplished except in the case of low molecular weight amines.

In the second stage, the Schiff base is reacted with aliphatic hydrocarbon-substituted succinic acid, anhydride or lower alkyl ester. The mole ratio of reactants can vary over a broad range. A useful range is 0.5–5 moles of hydrocarbon-substituted succinic compound per each 1–2 moles of initial aliphatic amine. A more preferred range is about 1–2 moles of hydrocarbon-substituted succinic compound per each mole of initial aliphatic amine.

The aliphatic hydrocarbon substituted succinic compound is usually made in a mineral oil solvent such as hydrotreated neutral oil. Depending upon solubility, the hydrocarbon-substituted succinic compound is generally about 5–70 weight percent of the oil solution. This oil is not removed and functions as a solvent in the second stage reaction of the Schiff base with the hydrocarbon-substituted succinic compound.

The second stage is conducted at a temperature high enough to cause amide or imide formation but not so high as to cause decomposition of the reactants. A useful temperature range is about 80°–200° C. The reaction is usually started at a low temperature of about 80°–100° C. and then gradually heated to about 150°–200° C. to complete the reaction. Some gelling may occur at the start of the reaction, but this disappears as the reaction proceeds.

In an alternative procedure which lessens the amount of gelling, the hydrocarbon-substituted succinic compound is used in the form of a half ester or acid-ester which is formed by reacting the succinic anhydride group with an alkanol, such as methanol, ethanol, propanol, butanol, hexanol, and the like. The ester group is displaced during the reaction and the resultant alkanol is distilled out.

The following examples illustrate how the additives are made.

EXAMPLE 1

This example show the preparation of a succinic anhydride grafted olefin copolymer.

In a reaction vessel was placed 2783 grams of hydrocracked SUS 80 neutral oil and 358.3 grams of a copolymer of ethylene, propylene, 1,4-hexadiene, and 2,5-norbornadiene having a weight average molecular weight of about 115,000. The mixture was stirred and heated at 220° C. until the rubbery copolymer dissolved. The mixture was cooled to 180° C. and 13.6 grams of maleic anhydride was added. This mixture was blanketed with nitrogen and stirred at 180° C. for 20 minutes while gradually adding a total of 2.4 grams of di-tert-butyl peroxide. Stirring was continued for one hour at 180° C. at which time 29 inches Hg vacuum was applied to remove volatiles. Infrared analysis showed the formation of succinic anhydride groups.

EXAMPLE 2

First Stage-Schiff Base

In a reaction vessel was placed 50 ml heptane, 132.2 grams of N-oleoylaminopropyl-1,3-propanediamine (Triamine T-Trademark, Armak Company) and 72.1 grams of isobutyraldehyde. The mixture was heated to reflux under nitrogen while water was removed using a Dean Stark trap. After three hours, a total of 14.5 ml. of water was collected. Vacuum was then applied (29 inches Hg) to remove heptane and unreacted isobutyraldehyde. Infrared analysis showed the formation of a Schiff base.

Second Stage

In a reaction vessel was placed 258.2 grams of the succinic-grafted copolymer from Example 1.

This was stirred at 80° C. and 5.6 grams of the above Schiff base was added. The mixture initially gelled and was heated further to 180° C. and stirred at that temperature for three hours. It became fluid. The mixture was then cooled leaving a viscous additive having both viscosity index improver and dispersant properties.

EXAMPLE 3

This example used an ester of the succinic-grafted copolymer rather than the anhydride.

In a reaction vessel was placed 249.5 grams of the succinic anhydride-grafted copolymer solution from Example 1. To this was added 2.6 grams 1-hexanol. This mixture was stirred and heated at 125° C. for one hour to convert the succinic anhydride groups to half-ester groups. Then 5.2 grams of the Schiff base from Example 2 was added and the mixture stirred and heated. It gelled slightly at 150° C. but thinned out after 20 minutes at 160° C. Stirring was continued for two hours at 160° C. and then 29 inches Hg vacuum was applied to remove volatiles leaving a viscous lube oil dispersant-VI improver.

EXAMPLE 4

In a reaction vessel was placed 208.4 grams of the succinic-grafted copolymer solution from Example 1 and 2.0 grams of 1-hexanol. This was stirred and heated at 130° C. to convert succinic anhydride groups to half-ester groups. It was then cooled and at 80° C., 2.3 grams of a Schiff base made from 2.6 grams of tetraethylenepentamine and 1.0 grams of isobutyraldehyde were added. The mixture was stirred and heated to 190° C. and stirred at this temperature for two hours. It was then vacuum stripped and then cooled leaving 211.7 grams of a viscous very effective dispersant-VI improver.

EXAMPLE 5

In a reaction vessel was placed 100.4 grams of N-(2-aminoethyl)-2-aminoethanol. To this was added slowly 72.0 grams of isobutyraldehyde followed by 100 ml. toluene. The mixture was stirred and heated under nitrogen to reflux while distilling out water using a Dean Stark trap. After 14 ml. of water was removed, an additional 72.2 grams of isobutyraldehyde were added in two increments while continuing to remove water. The reflux temperature rose gradually to 130° C. and a total of 34 ml. of water was removed. A 29 inch Hg. vacuum was applied to remove toluene and other volatiles leaving a Schiff base.

In a reaction vessel was placed 2522 grams of 80 SUS neutral mineral oil and 324.7 grams of the same copolymer used in Example 1. The copolymer was first cut into small pieces. The mixture was stirred at 220° C. under nitrogen for two hours to dissolve the rubbery copolymer. The solution was cooled to 180° C. and 12.3 grams of maleic anhydride were added. While stirring at 180° C. under nitrogen, 2.4 ml. of di-tert-butyl peroxide was added over a 22 minute period. Stirring was continued for 1.5 hours and then 28 inches Hg vacuum were applied to remove volatiles. Formation of succinic anhydride grafts was confirmed by infrared.

In a reaction vessel was placed 271.6 grams of the above succinic-grafted copolymer and 2.4 grams of 1-hexanol. This was stirred one hour at 135° C. to convert the succinic anhydride groups to half-ester groups. Then 2.5 grams of the above Schiff base were added and the mixture stirred at 150°-155° C. for 2.5 hours. A vacuum of 29 inches Hg was applied and volatiles, including displaced hexanol, were distilled out assisted by a nitrogen sparge. The product was a useful oil additive.

Other dispersants of this invention can be made following the above general procedure. For example, use of a polyisobutylene-substituted succinic anhydride will result in a polyisobutylene-substituted succinic Schiff base condensation product.

The effectiveness of the additive as a lubricating oil dispersant was measured using a bench dispersancy test. In this test, an asphaltene sludge was made by air oxidation of 100 neutral oil using an iron naphthenate catalyst. The oxidized oil containing precipitated sludge was diluted with heptane to dissolve some more of the sludge. The remainder was filtered off. The sludge-saturated filtrate stabilized with a small amount of butanol was used as the test sludge.

The test was conducted by mixing 1 ml. of sludge solution into 10 ml. 100 neutral mineral oil containing various amounts of test additives. The test samples were left standing for 16 plus hours and then rated visually. The test criterion was the lowest concentration of dispersant that prevents formation of a precipitate. Thus, the lower the concentration the more effective is the dispersant. The sludge solution was standardized against a presently commercial dispersant VI improver for comparisons. This commercial dispersant was effective down to 0.25 weight percent giving a precipitate at 0.125 percent.

The following table shows the performance of various additives at different concentrations.

| Additive of | Additive Concentration (percent) | | | | |
|---|---|---|---|---|---|
| Example | 0.06 | 0.125 | 0.25 | 0.5 | 1.0 |
| 2 | ppt | OK | OK | OK | OK |
| 3 | ppt | OK | OK | OK | OK |
| 4 | ppt | OK | OK | OK | OK |
| 5 | ppt | OK | OK | OK | OK |

These results show that the additives were quite effective at concentrations as low as 0.125 percent.

The additives are used in lubricating oil at a concentration which achieves the desired level of dispersancy and VI improvement. They may also independently be used in combination with non-dispersant VI improvers to achieve desired levels. This can usually be accomplished by adding about 0.2 to about 2.0 weight percent of active ingredient to the oil. In other words, 10 weight percent of a 10 weight percent active oil solution of additive would add about one weight percent additive.

The additives can be used in mineral oil or in synthetic oils of viscosity suitable for use in the crankcase of an internal combustion engine. Crankcase lubricating oils have a viscosity up to about 80 SUS at 210° F.

Crankcase lubricating oils of the present invention have a viscosity up to about SAE 40. Sometimes such motor oils are given a classification at both 0° and 210° F., such as SAE 10W 40 or SAE 5W 30.

Mineral oils include those of suitable viscosity refined from crude oil from all sources including Mid-East, Gulfcoast, midcontinent, Pennsylvania, California, Alaska, North Sea, and the like. Various standard refinery operations can be used in processing the mineral oil.

Synthetic oil includes both hydrocarbon synthetic oil and synthetic esters. Useful synthetic hydrocarbon oils include liquid polymers of α-olefins having the proper viscosity. Especially useful are the hydrogenated liquid oligomers of $C_{6-12}$ α-olefins such as α-decane trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di-(2-ethylhexyl) adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 10–25 weight percent hydrogenated $\alpha$-decene trimer with 75–90 weight percent 150 SUS (100° F.) mineral oil results in an excellent lubricant. Likewise, blends of about 10–25 weight percent di-(2-ethyl-hexyl) adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkaryldithiophosphates as well as mixed alkyl-aryl ZDDP are useful. A typical alkyl-type ZDDP contains a mixture of isobutyl and isoamyl groups. Zinc di-(nonylphenyl) dithiophosphate is a typical aryl-type ZDDP. Good results are achieved using sufficient ZDDP to provide about 0.01–0.5 weight percent zinc. A preferred concentration supplies about 0.05–0.3 weight percent zinc.

Another additive used in the oil compositions are the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 weight percent alkaline earth metal and more preferably about 0.1–1.0 weight percent. In a most preferred embodiment the lubricating oil composition contains a calcium petroleum sulfonate or alkaryl (e.g. alkylbenzene) sulfonate.

Other viscosity index improvers can be included such as the polyalkylmethacrylate-type or the ethylene-propylene copolymer type. Likewise, styrene-diene VI improvers or styrene-acrylate copolymers can be used. Alkaline earth metal salts of phosphosulfurized polyisobutylene are useful.

Many preferred crankcase oils also contain supplemental ashless dispersants such as the polyolefin-substituted succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. Nos. 3,172,892 and 3,219,666, incorporated herein by reference.

Another useful class of ashless dispersants are the polyolefin succinic esters of mono- and polyhydroxy alcohols containing 1 to about 40 carbon atoms. Such dispersants are described in U.S. Pat. Nos. 3,381,022 and 3,522,179.

Likewise, mixed ester/amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise, the succinic amide, imide and/or ester may be oxyalkylated by reaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,792,202; 3,798,165; 3,798,247 and 3,803,039.

We claim:

1. A lubricating oil additive having dispersant properties which is a product made by a process comprising the steps of (a) reacting 0.5–10 moles of an aliphatic aldehyde containing 1–20 carbon atoms with 1–2 moles of a saturated aliphatic amine having 2–50 carbon atoms and 2–11 amine nitrogen atoms, at least one of which is a primary amine group, at an elevated temperature high enough to distill out water and within the range of 70°–200° C. to form an intermediate and (b) reacting this intermediate at about 80°–200° C. with about 0.5–5 mole parts of an aliphatic hydrocarbon substituted succinic acid, anhydride or lower alkyl ester.

2. An additive of claim 1 wherein said aliphatic hydrocarbon substituent is a polybutenyl group having an average molecular weight of about 500–10,000.

3. An additive of claim 2 wherein said aliphatic amine is an alkylene polyamine having the structure $$H_2N\text{-}[R_1\text{—}NH]_nH$$

wherein $R_1$ is a divalent aliphatic hydrocarbon having 2–4 carbon atoms and n is an integer from 1–10.

4. An additive of claim 3 wherein said aldehyde is an aldehyde having 1–12 carbon atoms.

5. An additive of claim 2 wherein said aliphatic amine is an amine having the structure $$R_2\text{-}[NH\text{—}R_3]_pNH_2$$

wherein $R_2$ is an aliphatic hydrocarbon group having 8–30 carbon atoms, $R_3$ is a divalent aliphatic hydrocarbon group having 2–4 carbon atoms and p is an integer from 1–4.

6. An additive of claim 5 wherein $R_2$ is an aliphatic hydrocarbon group having 12–20 carbon atoms, $R_3$ is the group $\text{—}CH_2\text{—}CH_2\text{—}CH_2\text{—}$ and p is 2.

7. An additive of claim 2 wherein said aliphatic amine is an ether amine having the structure $$R_4\text{-}[O\text{—}R_5NH]_qH$$

wherein $R_4$ is an aliphatic hydrocarbon group having 1–30 carbon atoms, $R_5$ is a divalent aliphatic hydrocarbon group having 2–4 carbon atoms and q is an integer from 2–4.

8. An additive of claim 7 wherein $R_4$ is an aliphatic hydrocarbon group having 8–20 carbon atoms, $R_5$ is the group $—CH_2—CH_2—CH_2—$ and q is 2.

9. An additive of claim 8 wherein said aldehyde is an aldehyde having 1–12 carbon atoms.

10. An additive of claim 1 wherein said aliphatic hydrocarbon-substituted succinic compound is formed by a process comprising reacting a maleic anhydride with an olefin copolymer having an average molecular weight of about 10,000–300,000, said copolymer being derived from 25–60 weight percent ethylene, 30–74 weight percent propylene and 1–10 weight percent of a non-conjugated diene.

11. An additive of claim 10 wherein said copolymer has a weight average molecular weight of about 50,000–200,000 and is a copolymer derived from 40–60 weight percent ethylene, 35–60 weight percent propylene and 1–10 weight percent of a non-conjugated diene.

12. An additive of claim 11 wherein said non-conjugated diene comprises at least one diene selected from the group consisting of 1,4-hexadiene, 2,5-norbornadiene, dicyclopentadiene and ethylidene norbornene.

13. An additive of claim 10 wherein said amine is an alkylene polyamine having the structure $$H_2N\text{-}[R_1—N]_nH$$

wherein $R_1$ is a divalent aliphatic hydrocarbon having 2–4 carbon atoms and n is an integer from 1–10.

14. An additive of claim 13 wherein said copolymer has a weight average molecular weight of about 50,000–200,000 and is a copolymer derived from about 40–60 weight percent ethylene, 35–60 weight percent propylene and 1–10 weight percent non-conjugated diene selected from the group consisting of 1,4-hexadiene, 2,5-norbornadiene, dicyclopentadiene, ethylidene norbornene and mixtures thereof.

15. An additive of claim 14 wherein said aldehyde is an aldehyde having 1–12 carbon atoms.

16. An additive of claim 10 wherein said aliphatic amine is an amine having the structure $$R_2—NH—R_3—_nNH_2$$

wherein $R_2$ is an aliphatic hydrocarbon group having 8–30 carbon atoms, $R_3$ is a divalent aliphatic hydrocarbon group having 2–4 carbon atoms and n is an integer from 1–4.

17. An additive of claim 16 wherein $R_2$ is an aliphatic hydrocarbon group having 12–20 carbon atoms, $R_3$ is the group $—CH_2—CH_2—CH_2—$ and n is 2.

18. An additive of claim 17 wherein said olefin copolymer has a weight average molecular weight of about 50,000–200,000 and is a copolymer derived from about 40–60 weight percent ethylene, 35–60 weight percent propylene, and 1–10 weight percent of a non-conjugated diene selected from the group consisting of 1,4-hexadiene, 2,5-norbornadiene, dicyclopentadiene, ethylidene norbornene, and mixtures thereof.

19. An additive of claim 18 wherein said aldehyde is an aldehyde having from 1–12 carbon atoms.

20. An additive of claim 19 wherein said aldehyde is isobutyraldehyde.

21. An additive of claim 10 wherein said aliphatic amine is an ether amine having the structure $$R_4\text{-}[O—R_5NH]_qH$$

wherein $R_4$ is an aliphatic hydrocarbon group having 1–30 carbon atoms, $R_5$ is a divalent aliphatic hydrocarbon group having 2–4 carbon atoms and q is an integer from 2–4.

22. An additive of claim 21 wherein $R_4$ is an aliphatic hydrocarbon group having 8–20 carbon atoms, $R_5$ is the group $—CH_2—CH_2—CH_2—$ and q is 2.

23. An additive of claim 22 wherein said copolymer has a weight average molecular weight of about 50,000–200,000 and is a copolymer derived from about 40–60 weight percent ethylene, 35–60 weight percent propylene, and 1–10 weight percent of a non-conjugated diene selected from the group consisting of 1,4-hexadiene, 2,5-norbornadiene, dicyclopentadiene, ethylidene norbornene, and mixtures thereof.

24. An additive of claim 23 wherein said aldehyde is an alkanal having 1–12 carbon atoms.

* * * * *

UNITED STATES PATENT AND TRADEMARK OFFICE

CERTIFICATE OF CORRECTION

PATENT NO. : 4,448,974

DATED : May 15, 1984

INVENTOR(S) : JOSEPH P. O'BRIEN ET AL.

It is certified that error appears in the above-identified patent and that said Letters Patent is hereby corrected as shown below:

Column 1, line 65, reads "$H_2N-R_1-NH-_nH$", should read --$H_2N\{R_1-NH\}_nH$--.

Column 2, line 30, reads "$R_4\{O-R_5NH\}_qH$", should read --$R_4-O\{R_5NH\}_qH$--.

Column 6, line 66, reads "decane", should read --decene--.

Column 8, line 62, reads "$R_4\{O-R_5NH\}_qH$", should read --$R_4-O\{R_5NH\}_qH$--.

Column 10, line 1, reads "$R_2-NH-R_3-_nNH_2$", should read --$R_2\{NH-R_3\}_nNH_2$--.

Column 10, line 25, reads "$R_4\{O-R_5NH\}_qH$", should read --$R_4O\{R_5NH\}_qH$--.

Signed and Sealed this

Second Day of October 1984

[SEAL]

*Attest:*

GERALD J. MOSSINGHOFF

*Attesting Officer*

*Commissioner of Patents and Trademarks*